US006067059A

United States Patent [19]

Chen

[11] Patent Number: 6,067,059

[45] Date of Patent: May 23, 2000

[54] LASER DOT MATRIX DISPLAY SYSTEMS

[75] Inventor: Tony K. T. Chen, Ping-Chen, Taiwan

[73] Assignee: Quarton, Inc., Taiwan

[21] Appl. No.: 09/018,580

[22] Filed: Feb. 4, 1998

[51] Int. Cl.[7] ..... G06G 3/36

[52] U.S. Cl. ..... 345/32; 345/84

[58] Field of Search ..... 345/32, 87, 84; 348/750, 759; 359/216, 226

[56] References Cited

U.S. PATENT DOCUMENTS

| | | | |
|---|---|---|---|
| 4,654,716 | 3/1987 | Zimmerman | 29/270 |
| 5,032,924 | 7/1991 | Brown et al. | 348/759 |
| 5,054,930 | 10/1991 | Adelson | 356/218 |
| 5,140,427 | 8/1992 | Nakane et al. | 348/759 |
| 5,172,419 | 12/1992 | Manian | 382/132 |
| 5,295,143 | 3/1994 | Rao et al. | 372/22 |
| 5,757,341 | 5/1998 | Clarke et al. | 345/32 |
| 5,874,929 | 2/1999 | Opower et al. | 345/32 |
| 5,905,751 | 5/1999 | Huang et al. | 372/101 |
| 5,917,462 | 6/1999 | Suzuki et al. | 345/32 |

*Primary Examiner*—Richard A. Hjerpe
*Assistant Examiner*—Marthe Marc-Coleman
*Attorney, Agent, or Firm*—Raymond Sun

[57] ABSTRACT

Laser systems are provided that include a turntable having a plurality of circumferential mirrors that are rotatably controlled by one motor. One or more laser modules are oriented to direct laser beams at the mirrors, as the mirrors are rotated. Each beam that is reflected by a mirror forms a dot of the desired image. The vertical level of the formed dots is controlled either by providing the mirrors at different angles, or by providing a plurality of laser modules at differently angled orientations or at different vertical positions. The positioning of dots along a horizontal line is controlled by synchronizing the rate of rotation of the turntable with the on-off times of the laser module(s).

23 Claims, 8 Drawing Sheets

LASER DOT MATRIX DISPLAY SYSTEMS

BACKGROUND OF THE INVENTION

1. Field of the Invention

The present invention relates to laser display systems, and in particular, laser display systems producing images based on the dot matrix principle.

2. Description of the Prior Art

Lasers are commonly used to display images that include both letters and pictorial images. One conventional laser system is provided in the form of a housing that houses or contains a laser source, a mirror system, and a pair of stepping motors. One of the motors is an X-part stepping motor that controls a first mirror along a first, or X, axis, and the other motor is a Y-part stepping motor that controls a second mirror along a second, or Y, axis. A laser beam from the laser source is directed to the first mirror which reflects and adjusts the orientation of the beam towards the second mirror. The second mirror then reflects and adjusts the orientation of the beam towards a target or screen. To produce the desired images, the two motors must be controlled in a synchronized manner and at fast speeds to continuously adjust the orientations of the first and second mirrors. Unfortunately, such a conventional laser system suffers from two drawbacks.

First, the construction and operation of the conventional laser system can be rather complex, since two motors must be controlled in a synchronized manner and at fast speeds to continuously adjust the orientations of the first and second mirrors. As a result, the cost of the conventional laser system is increased.

Second, the images produced by such a conventional laser system do not exhibit a consistent brightness. In particular, the images tend to be brighter at areas where a corner is created. For example, when producing an image of the letter "A", the apex of the "A" tends to be brighter because there is a greater concentration of laser beams at the area of the apex than at any of the other areas of the letter "A".

Thus, there still remains a need for a laser system which produces consistent and clear images, which is simple in construction, and which is inexpensive to manufacture.

SUMMARY OF THE DISCLOSURE

The objects of the present invention may be accomplished by providing a laser system that uses the dot matrix principle to produce images. The laser systems according to the present invention include a turntable having a plurality of circumferential mirrors that are rotatably controlled by one motor. One or more laser modules are oriented to direct laser beams at the mirrors, as the mirrors are rotated. Each beam that is reflected by a mirror forms a dot of the desired image. The vertical level of the formed dots is controlled either by providing the mirrors at different angles, or by providing a plurality of laser modules at differently angled orientations or at different vertical positions. The positioning of dots along a horizontal line is controlled by synchronizing the rate of rotation of the turntable with the on-off times.

According to one embodiment of the present invention, additional laser modules can be provided to create colored images.

According to another embodiment of the present invention, additional laser modules can be provided to create wider images.

According to yet another embodiment of the present invention, a projection lens can be provided so that the components of the laser system can be provided in smaller sizes.

Thus, the laser systems of the present invention utilize only one motor, which greatly reduces the complexity of the structure and of the operation, thereby reducing the cost of manufacture. The use of the dot matrix principle by the laser systems of the present invention also provides consistent and high-quality images.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known circuits and components are omitted so as to not obscure the description of the present invention with unnecessary detail.

The present invention provides a laser system that uses the dot matrix principle to produce images. A turntable having a plurality of circumferential mirrors is rotatably controlled by one motor. One or more laser modules are oriented to direct laser beams at the mirrors, as the mirrors are rotated. Each beam that is reflected by a mirror forms a dot of the desired image. The vertical level of the formed dots is controlled either by providing the mirrors at different angles, or by providing a plurality of laser modules at differently angled orientations. The positioning of dots along a horizontal line is controlled by synchronizing the rate of rotation (i.e., the rotation speed) of the turntable with the on-off times (also known as switching times) of the laser module(s). Additional laser modules can be provided to create colored images, and to create wider images.

Figure 2:
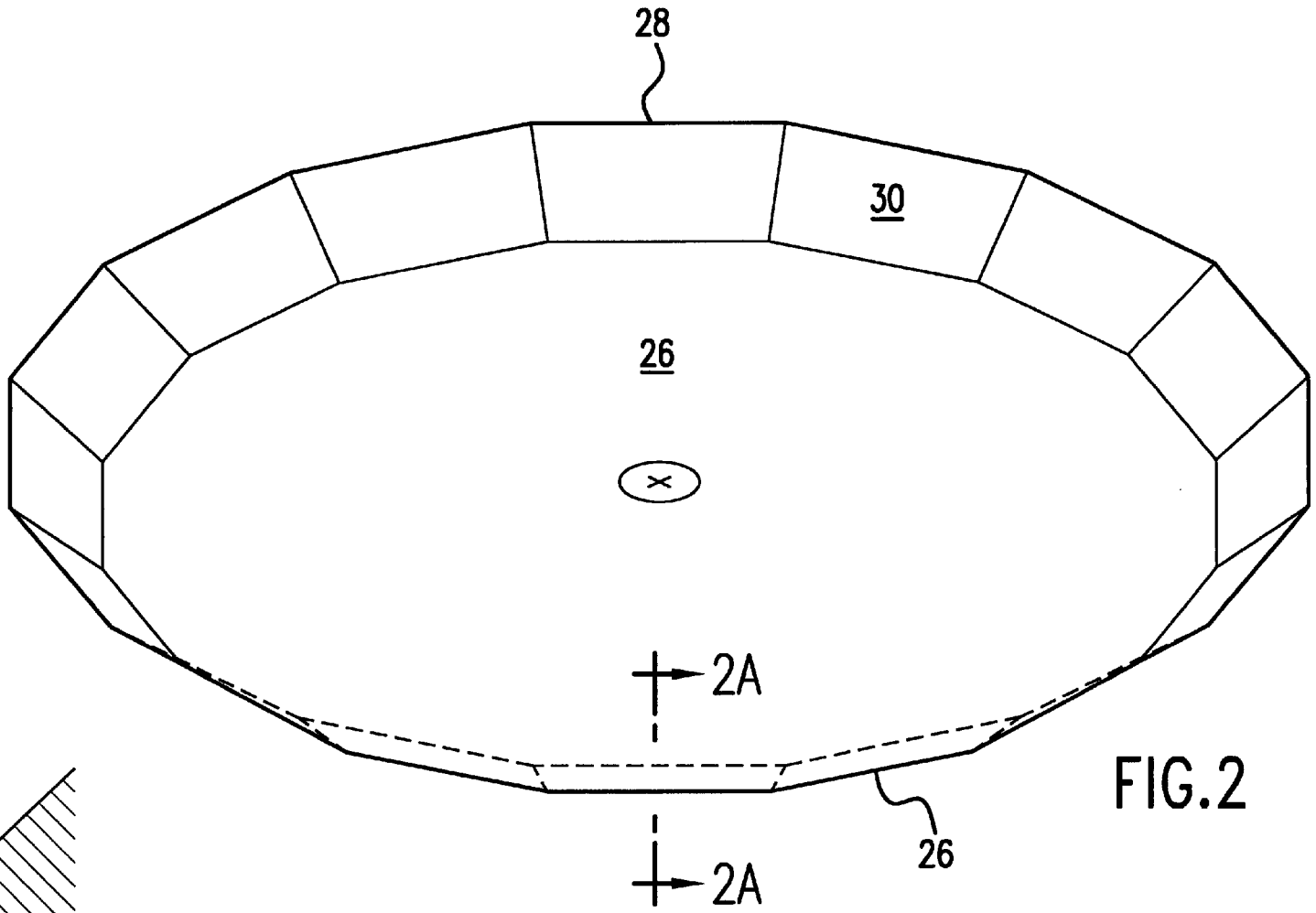
FIG. 2 is a perspective view of the turntable of the laser system of FIGS. 1A–1E.

Referring to FIGS. 1 and 2, a laser system 20 according to a first embodiment of the present invention includes a turntable 22 coupled to and rotatably controlled by a motor 24. The turntable 22 has a lower surface 26 which has a smaller profile or diameter than an upper surface 28 so as to provide a plurality of mirrors 30 that are circumferentially disposed at angled orientations between the upper surface 28 and the lower surface 26. A laser module 32 is disposed adjacent the turntable 22 and oriented to direct a plurality of laser beams L at the plurality of mirrors 30 at desired times. The mirrors 30 operate to reflect the laser beam L away from the turntable 22 towards the desired screen (not shown) or target space where the image is to be displayed. Each mirror 30 therefore creates one or more "dots" (also known as "pixels") of laser which together make up the desired image.

Figure 2A:
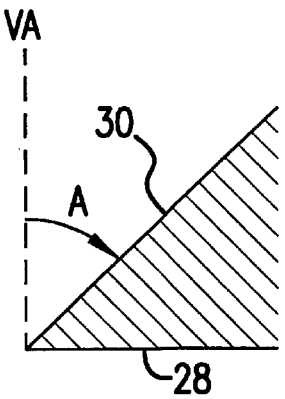
FIG. 2A is a partial cross-sectional view of one of the mirrors of the turntable of FIG. 2 taken along line A—A thereof.

Each mirror 30 is disposed at different and varying angles so that the laser beam L can be reflected at different vertical levels. For example, referring to FIG. 2A, one mirror 30 is provided at an angle A with respect to the vertical axis VA. The angle A is preferably different for each mirror 30. In addition, the horizontal orientation of the reflected laser beam L can be varied by controlling and synchronizing the rate of rotation (i.e., the rotation speed) of the turntable 22 and the on-off (i.e., switching) times of the laser module 32. Thus, a desired image can be created by rotating the turntable 22 at controlled speeds so that the laser beams L emitted by the laser module 32 at predetermined times are modified by the angled mirrors 30 to produce a plurality of different "dots" of the laser beam that together create the desired image. As a result, the resulting image is made up a matrix of these created "dots".

Figure 3:
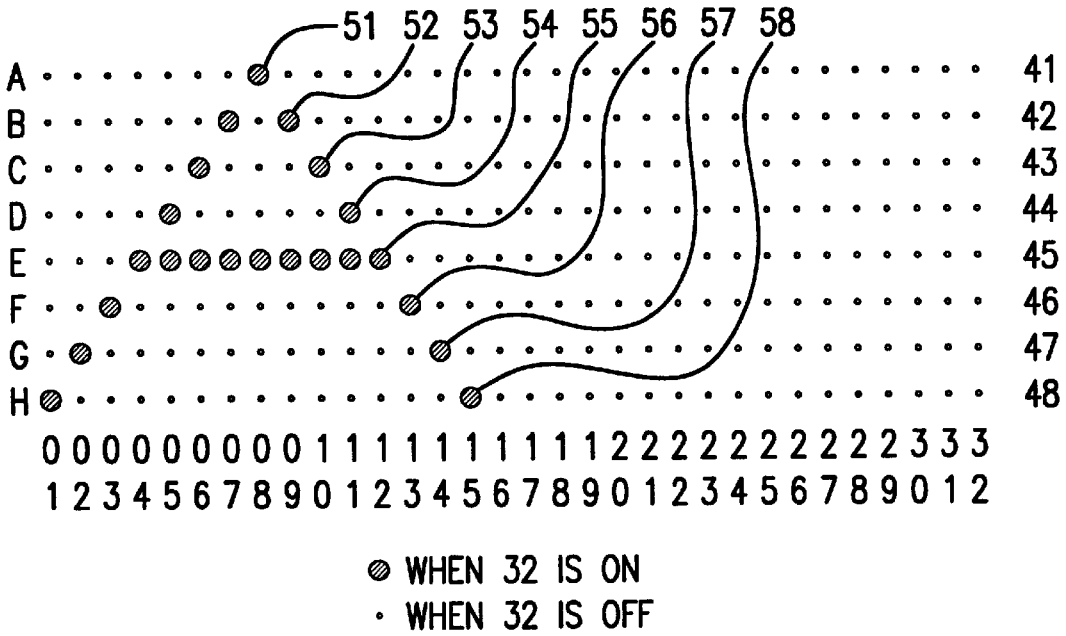
FIG. 3 illustrates the dot matrix principle used by the laser systems of the present invention to produce images.

FIGS. 1A–1E and 3 provide a simple illustration of the operation of this principle. For example, it is desired to create an image of the letter "A". This letter "A" is illustrated in FIG. 3 as being comprised of eight lines 41–48 of "dots". Each line 41–48 may be comprised of 32 pixels numbered from 1 through 32 at the bottom of FIG. 3. To create the "A", the first line 41 has only one dot 51, the second line 42 has two spaced-apart dots 52, the third line 43 has two spaced-apart dots 53 that are spaced apart further than the dots 52 on the previous line, the fourth line 44 has two spaced-apart dots 54 that are spaced apart further than the dots 53 on the previous line, the fifth line 45 has nine spaced-apart dots 55, and the sixth, seventh and eighth lines 46, 47, 48, respectively, each has two spaced-apart dots 56, 57, 58, respectively, that are spaced apart further than the dots on the previous line.

As explained in greater detail hereinbelow, to create this image of the letter "A", the turntable 22 is provided with eight different mirrors 30*a*, 30*b*, 30*c*, 30*d*, 30*e*, 30*f*, 30*g* and 30*h*, each having a different angle for use in reflecting laser beams L to create the "dot" pattern for each line 41–48, respectively. Specifically, the mirror 30*a* is oriented at the smallest angle A with respect to the vertical axis VA, since it is responsible for reflecting laser beams L to produce the top or first line 41. Conversely, the mirror 30*h* is oriented at the greatest angle with respect to the vertical axis VA, since it is responsible for reflecting laser beams L to produce the bottom or eighth line 48. In addition, the rate of rotation of the turntable 22 and on-off times of the laser module 32 are controlled to produce a different number of dots, and to control the specific location(s) of these dot(s) in each mirror 30. For example, by increasing the rate of rotation of the turntable 22, each line 41–48 can have fewer than 32 pixels. Similarly, by decreasing the rate of rotation of the turntable 22, each line 41–48 can have more than 32 pixels. The rate of rotation of the turntable 22 can be controlled by controlling the rate of rotation of the motor 24 which couples and drives the turntable 22.

The laser system 20 operates in the following manner. To produce the dot 51 in the top or first line 41, the turntable 22 is rotated at a particular speed and the laser module 32 is controlled to emit one laser beam L to be directed at the mirror 30*a* at the location of the eighth pixel A8 on line 41. See FIG. 1A. The laser module 32 is off during the rotation of the turntable 22 at the locations of the other pixels along line 41. The vertical orientation does not need to be adjusted, since the angle of the mirror 30*a* has already been fixed. The rotation of the turntable 22 will then carry the next mirror 30*b* to be aligned with the path of the laser beams L.

Next, to produce the two dots 52 on the second line 42, the turntable 22 may be rotated at the same speed and the laser module 32 is controlled to emit two laser beams L to be directed at the mirror 30*b* at the locations of the seventh pixel B7 and the ninth pixel B9 on line 42. The laser module 32 is off during the rotation of the turntable 22 at the locations of the other pixels along line 42. The vertical orientation again does not need to be adjusted, since the angle of the mirror 30*b* has already been fixed. The rotation of the turntable 22 will carry the next mirror 30*c* to be aligned with the path of the laser beams L. The same steps are repeated to produce the two dots 53 on line 43 (at the locations of the sixth pixel C6 and the tenth pixel C10), and the two dots 54 on line 44 (at the locations of the fifth pixel D5 and the eleventh pixel D11).

Next, to produce the nine dots 55 on the fifth line 45, the laser module 32 is controlled to emit nine consecutive laser beams L to be directed at the mirror 30*e* at the locations of the fourth pixel E4 through the twelfth pixel E12. This is illustrated in FIGS. 1B–1E, which shows four of the nine laser beams L being emitted as the mirror 30*e* sweeps across the path of the laser beams L. The laser module 32 is off during the rotation of the turntable 22 at the locations of the other pixels along line 42. The vertical orientation again does not need to be adjusted, since the angle of the mirror 30*e* has already been fixed. The rotation of the turntable 22 will carry the next mirror 30*f* to be aligned with the path of the laser beams L.

The same process is used to produce the two dots 56 on line 46 (at the locations of the third pixel F3 and the thirteenth pixel F13), the two dots 57 on line 47 (at the locations of the second pixel G2 and the fourteenth pixel G14), and the two dots 58 on line 48 (at the locations of the first pixel H1 and the fifteenth pixel H15).

As a result, it can be seen that the on-off times of the laser modules 32 are controlled to cause the laser module 32 to produce dots 51–58 that are intended to appear in different locations on each line 41–48, to produce the desired image of the letter "A".

In addition, those skilled in the art will appreciate that the resolution of the desired image can be enhanced by providing a greater number of dots in each designated area of display. For example, the resolution of the letter "A" in FIG. 3 can be improved by using additional lines, and additional dots per line, to exhibit the letter "A". To accomplish this enhanced resolution, a corresponding number of additional mirrors 30 must be provided for the additional lines, and the rate of rotation of the turntable 22 and the on-off times of the laser module 32 will need to be controlled and synchronized accordingly to produce additional lines and/or additional dots per line.

Figure 4:
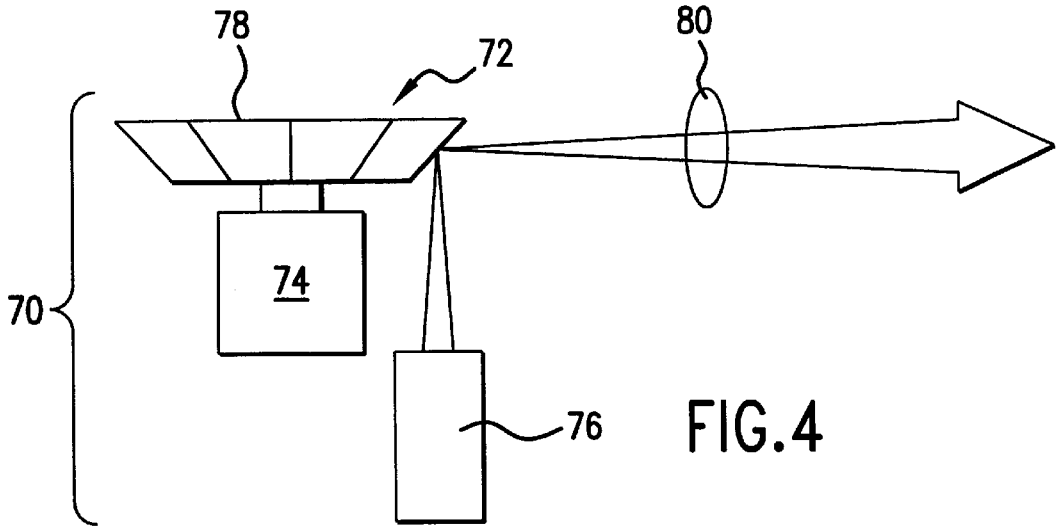
FIG. 4 is a simplified side view of a laser system according to a second embodiment of the present invention.

The basic principles illustrated in connection with the laser system 20 can be applied to a number of alternative laser systems. FIG. 4 illustrates a laser system 70 according to a second embodiment of the present-invention. The laser system 70 is similar to the laser system 20 in that a motor 74 is provided to rotatably drive and control a turntable 72, and a laser module 76 directs laser beams at mirrors 78 on the turntable 72 to create the desired image, according to the process described above in connection with FIGS. 1 and 3. The differences between the laser systems 20 and 70 are that (1) a projections lens 80 is positioned to receive and pass the reflected laser beams, and (2) the turntable 72 is smaller than the turntable 22. By focusing the reflected laser beams at a projection lens 80, the components of the laser system 70, and in particular, the turntable 72 and the motor 74, can be made smaller, thereby reducing the cost and size of the laser system 70.

Figure 5:
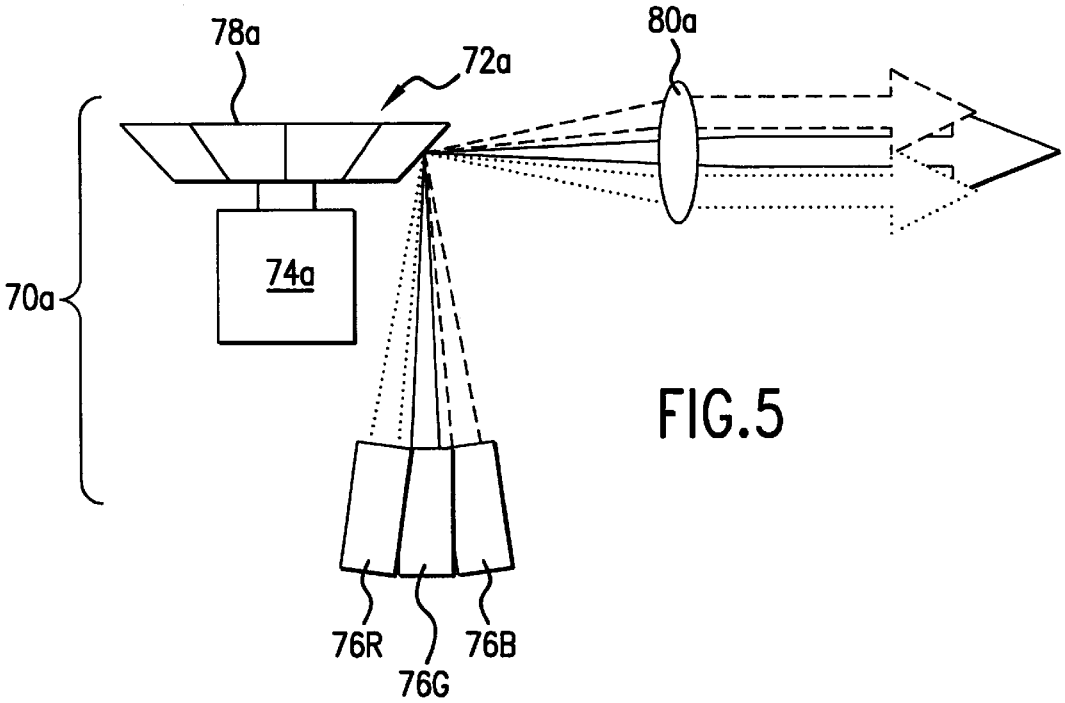
FIG. 5 is a simplified side view of a laser system according to a third embodiment of the present invention.

FIG. 5 illustrates a laser system 70*a* according to a third embodiment of the present invention. Laser system 70*a* includes essentially the same components as laser system 70 of FIG. 4, except that three laser modules 76R, 76G and 76B are provided instead of the one laser module 76, to provide colored laser images. The three laser modules 76R, 76G and 76B each simultaneously directs a laser beam of a different color (red, green and blue) at the same point or location on a mirror 78*a* to create the desired image, according to the process described above in connection with FIGS. 1A–1E and 3. Thus, instead of directing one laser beam L against a particular point on a mirror 78*a*, the laser system 70*a* simultaneously directs three colored laser beams at the particular point on the mirror 78*a*. The three simultaneously-emitted colored beams are reflected by the same mirror 78*a* and focused at a projection lens 80*a*. The provision of the projection lens 80*a* allows the components of the laser system 70*a* to be made smaller, thereby reducing the cost and size of the laser system 70*a*.

Figure 6:
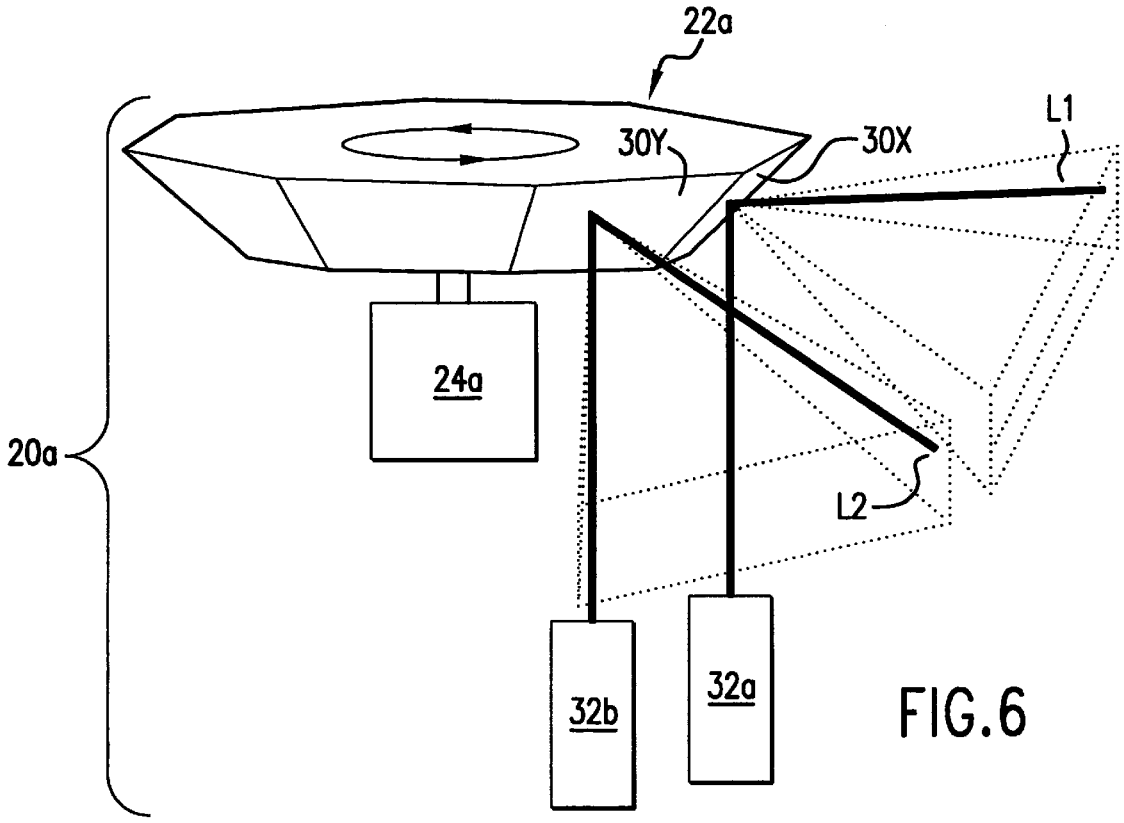
FIG. 6 is a simplified perspective view of a laser system according to a fourth embodiment of the present invention.

FIG. 6 illustrates a laser system 20*a* according to a fourth embodiment of the present invention. Laser system 20*a* includes essentially the same components as laser system 20 of FIG. 1, including a motor 24*a* for rotatably controlling a turntable 22*a*, except that two laser modules 32*a* and 32*b* are provided instead of the one laser module 32. The two laser modules 32*a* and 32*b* simultaneously emit laser beams L1 and L2, which are simultaneously reflected by two adjacent mirrors 30X and 30Y respectively, to create the desired image, according to the process described above in connection with FIGS. 1A–1E and 3. Thus, while the laser system 20 produces single dots to create the desired image, the laser system 20*a* produces double dots to create the desired image. The use of double dots creates a wider image. Those skilled in the art will appreciate that it is also possible to provide three or more laser modules emitting three or more simultaneous laser beams at three or more adjacent mirrors to create an even wider image.

Figure 7:
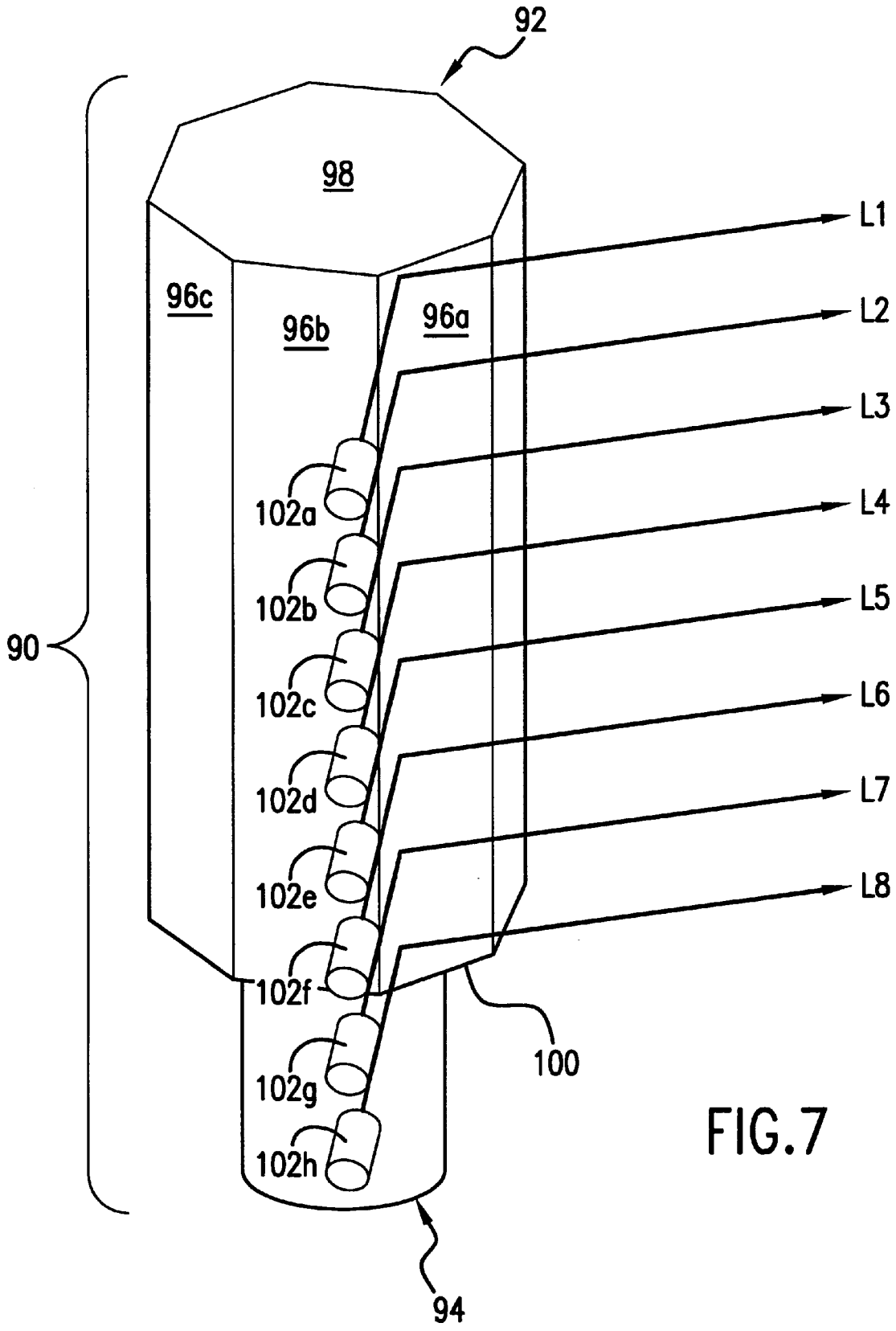
FIG. 7 is a simplified perspective view of a laser system according to a fifth embodiment of the present invention.

FIG. 7 illustrates a laser system 90 according to a fifth embodiment of the present invention. The laser system 90 includes a rotating block or turntable 92 that is coupled to and is rotatably controlled by a motor 94. The turntable 92 has a generally polygonal configuration having a plurality of mirrors 96 that are circumferentially disposed at a generally vertical orientation between an upper surface 98 and a lower surface 100. All the mirrors 96 are oriented at the same angle. A plurality of laser modules 102*a*–102*h* are disposed adjacent the turntable 92, and each laser module 102 is oriented, and its on-off times controlled, to direct a plurality of laser beams L1–L8 at the plurality of mirrors 96 at selected times. The mirrors 96 operate to reflect the laser beam L away from the turntable 92 towards the desired screen (not shown) or target space where the image is to be displayed. Each mirror 96 therefore reflects a laser beam to create one or more "dots" which together make up the desired image.

Each laser module 102 is disposed at different and varying positions, and/or different and varying angles, so that the laser beams L1–L8 can be reflected by the mirrors 96 at different vertical levels. For example, referring to FIG. 7, a first laser module 102*a* is provided at a greater vertical height than the other laser modules 102*b*–102*h*, and is adapted to create dots along a top line of the image. Similarly, the second laser module 102*b* is provided at a lower vertical level than the first laser module 102*a*, but at a greater vertical height than the other laser modules 102*c*–102*h*, and is adapted to create dots along a second line of the image. The other laser modules 102*c*–102*h* are similarly provided at different vertical levels to create dots along different lines of the image. Specifically, to create the image of the letter "A" in FIG. 3, the first laser module 102*a* would be responsible for creating the single dot 51 on line 41, the second laser module 102*b* would be responsible for creating the two dots 52 on line 42, the third laser module 102*c* would be responsible for creating the two dots 53 on line 43, the fourth laser module 102*d* would be responsible for creating the two dots 54 on line 44, the fifth laser module 102*e* would be responsible for creating the nine dots 55 on line 45, and so on.

Thus, as illustrated above, a desired image can be created by rotating the turntable 92 at controlled speeds with the laser modules 102*a*–102*h* controlled to emit laser beams L1–L8 at predetermined times, and at predetermined positions, to produce a plurality of different "dots" of the laser beam that together create the desired image. Although FIG. 7 illustrates the plurality of laser modules 102*a*–102*h* as being positioned vertically along the side of the turntable 92, with each of the laser modules 102*a*–102*h* oriented at about the same angle, it is also possible to position the plurality of laser modules 102*a*–102*h* at different angles with respect to a vertical axis to direct laser beams L1–L8 at the same mirror 96 of the turntable 92 to create the dots on the different vertical lines. In addition, although eight laser modules 102*a*–102*h* are shown, it is possible to provide any number of laser modules 102 in the system 90 of FIG. 7.

As a result, the system 90 of FIG. 7 differs from the system 20 of FIG. 1 in that the system 90 uses a plurality of laser modules 102 that are oriented at different positions and/or at different angles to create dots on separate lines of the image, while the system 20 varies the angles on the different mirrors 30 of the turntable 22 to accomplish the same result. In contrast, the system 90 provides all the mirrors 96 at the same angle, while the system 20 uses only one laser module 32 which emits a plurality of laser beams L at predetermined times.

Figure 8:
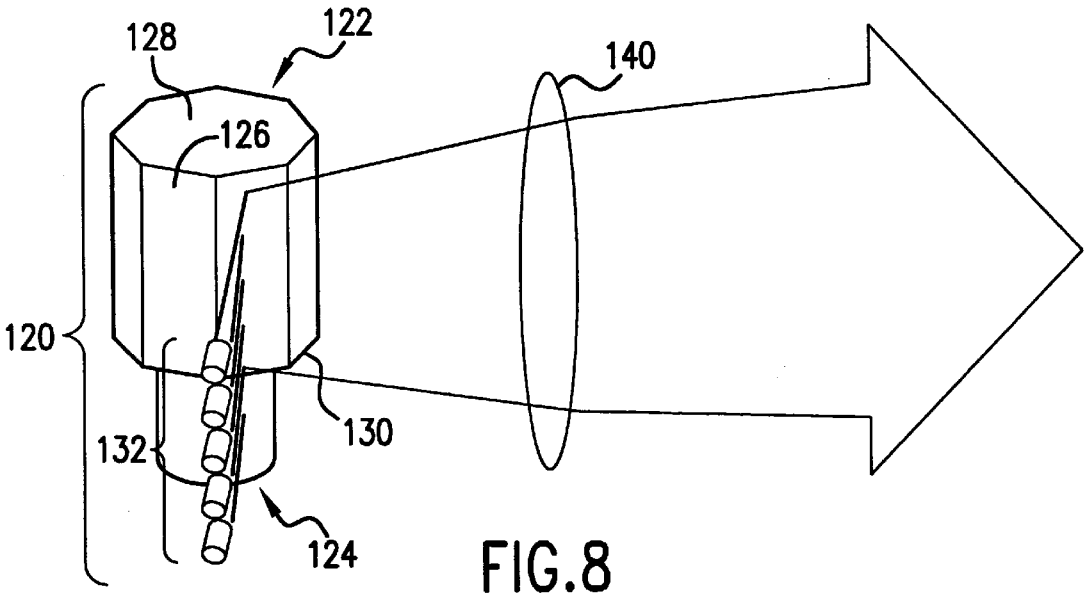
FIG. 8 is a simplified perspective view of a laser system according to a sixth embodiment of the present invention.

FIG. 8 illustrates a laser system 120 according to a sixth embodiment of the present invention. The laser system 120 employs the principles of the laser system 70 of FIG. 4 in the embodiment of laser system 90 described in connection with FIG. 7. As with the laser system 90, the laser system 120 has a turntable 122 that is coupled to and rotatably controlled by a motor 124. The turntable 122 has a generally polygonal configuration having a plurality of mirrors 126 that are circumferentially disposed at a generally vertical orientation between an upper surface 128 and a lower surface 130. All the mirrors 126 are oriented at the same angle. However, the turntable 122 is smaller than the turntable 92, so the mirrors 126 are smaller. A plurality of laser modules 132 are disposed adjacent the turntable 122, and each laser module 132 is oriented to direct a plurality of laser beams L at the plurality of mirrors 96 at desired times, according to the process described above in connection with FIGS. 3 and 7. The mirrors 126 operate to reflect the laser beams L away from the turntable 122.

As with system 70 of FIG. 4, a projections lens 140 is positioned to receive and pass the reflected laser beams L reflected from the mirrors 126. By focusing the reflected laser beams L at a projection lens 140, the components of the laser system 90, and in particular, the turntable 122 and the motor 124, can be made smaller, thereby reducing the cost and size of the laser system 120.

Figure 9:
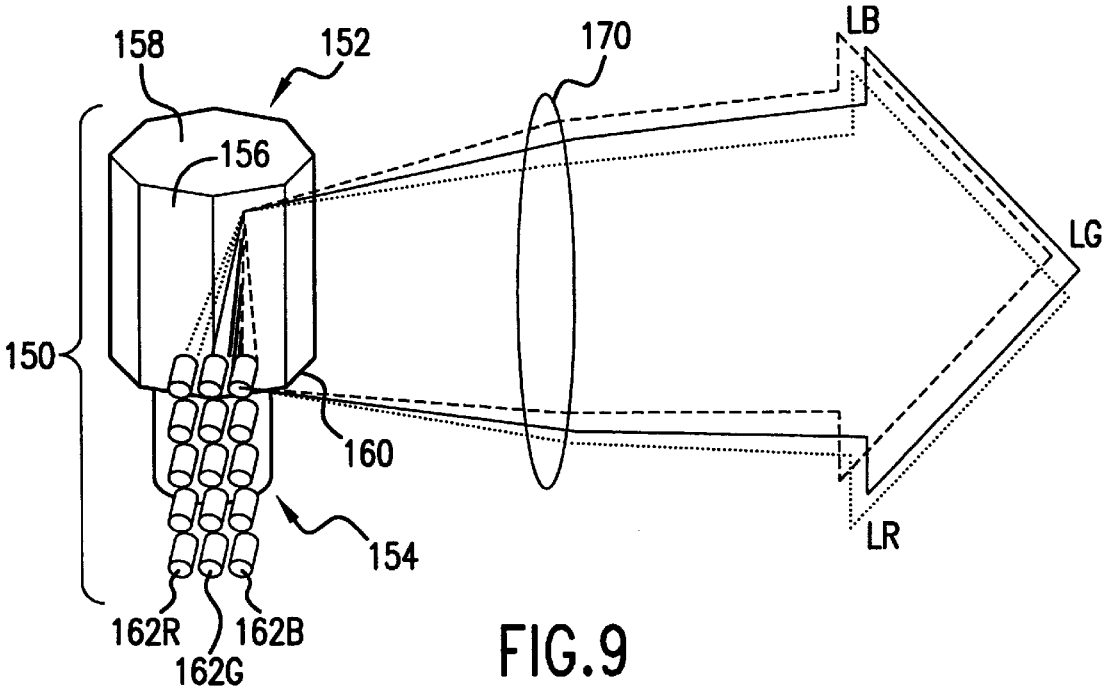
FIG. 9 is a simplified perspective view of a laser system according to a seventh embodiment of the present invention.

FIG. 9 illustrates a laser system 150 according to a seventh embodiment of the present invention. The laser system 150 employs the principles of the laser system 70*a* of FIG. 5 in the embodiment of laser system 90 described in connection with FIG. 7. As with the laser system 90, the laser system 150 has a turntable 152 that is coupled to and rotatably controlled by a motor 154. The turntable 152 has a generally polygonal configuration having a plurality of mirrors 156 that are circumferentially disposed at a generally vertical orientation between an upper surface 158 and a lower surface 160. All the mirrors 156 are oriented at the same angle. However, the turntable 152 is smaller than the turntable 152, so the mirrors 156 are smaller. A plurality of groups of laser modules 162R, 162G and 162B are provided, and each laser module 162R, 162G, 162B is oriented to direct a plurality of laser beams LR, LG, LE, respectively, at the plurality of mirrors 156 at desired times, according to the process described above in connection with FIGS. 3 and 7. The mirrors 156 operate to reflect the laser beams LR, LG, LB away from the turntable 152 towards the desired screen (not shown) or target space where the image is to be displayed.

As with the laser system 70*a*, the three laser modules 162R, 162G and 162B in each group simultaneously direct laser beams of three different colors (red, green and blue) at the same point or location on a mirror 156 to provide colored images. Each group of three simultaneously-emitted colored beams LR, LG, LB is reflected by the same mirror 156 and focused at a projection lens 170.

In addition, the operation principles of the laser system 20*a* of FIG. 6 can be applied to the embodiments of FIG. 7–9. For example, each laser module 102 in the laser system 90 of FIG. 7 can be replaced by multiple laser modules according to the principles of the laser system 20*a* of FIG. 6. These multiple laser modules simultaneously emit laser beams, which are simultaneously reflected by two or more adjacent mirrors on the turntable 92. The resulting system would also produce multiple dots for each desired dot so as to create a wider image.

Figure 1A:
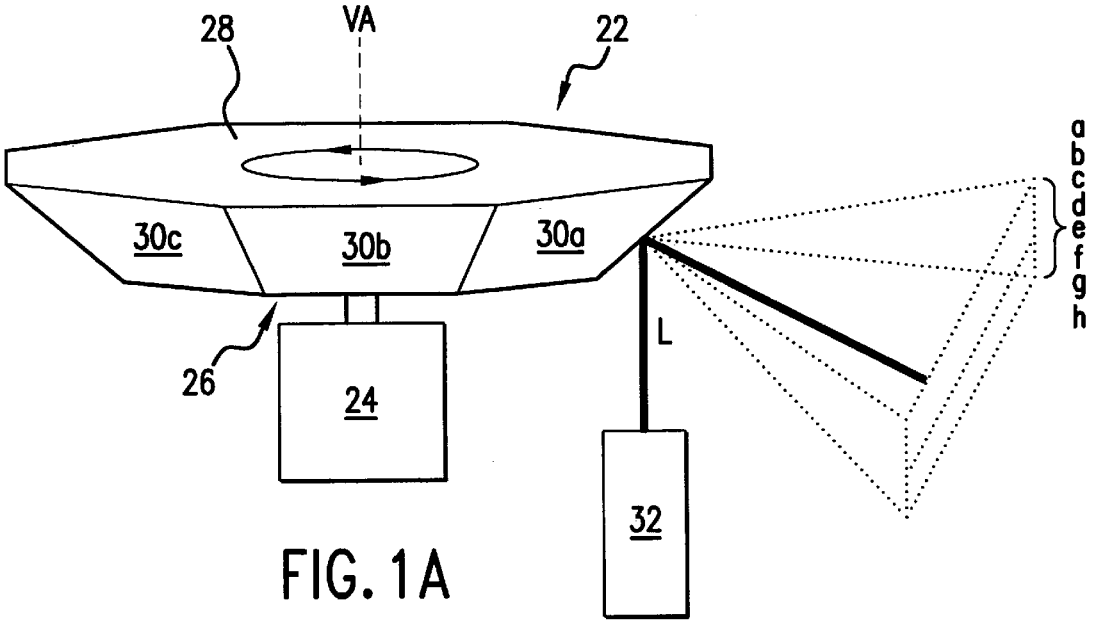
FIGS. 1A–1E are simplified perspective views of a laser system according to a first embodiment of the present invention illustrating the operation of the laser system.
Figure 1B:
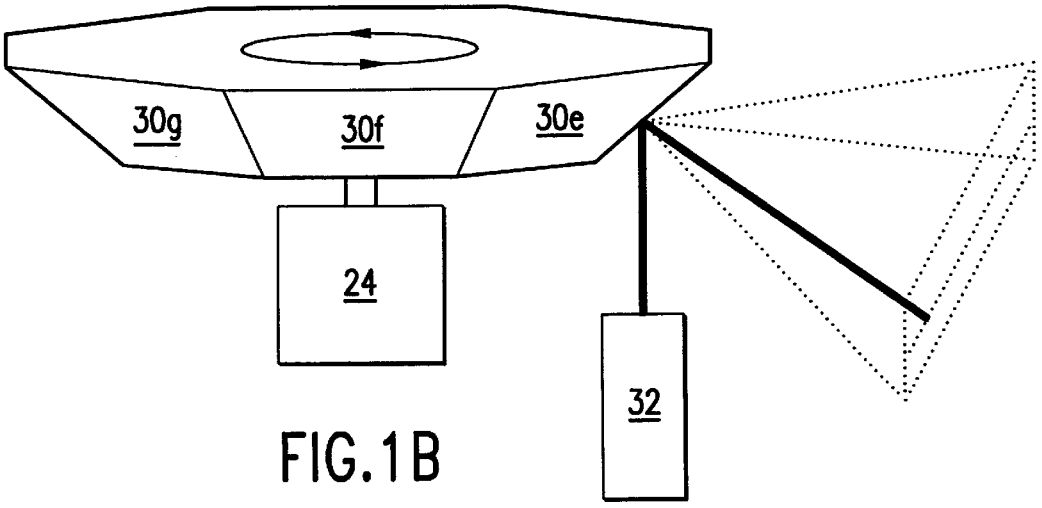
Figure 1C:
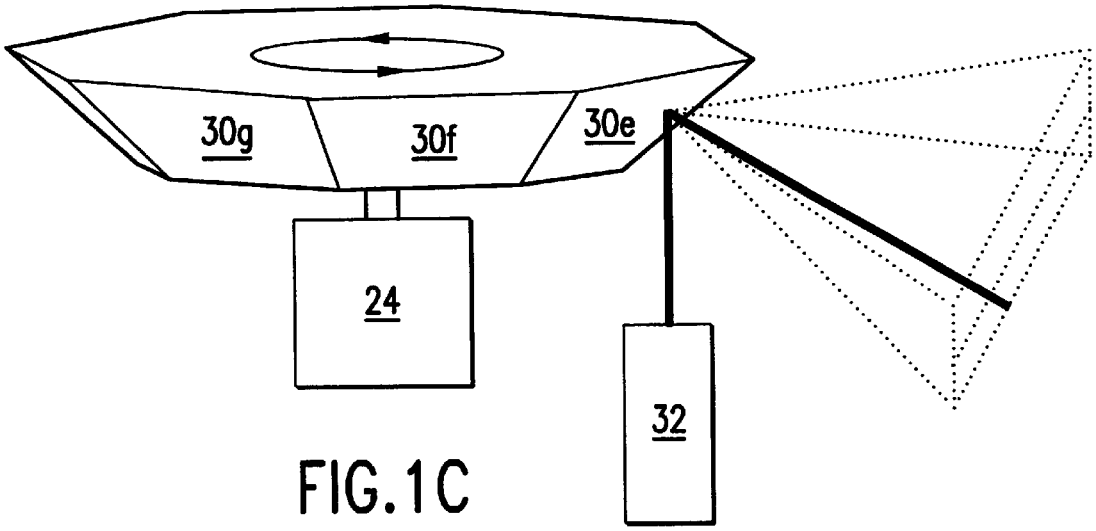
Figure 1D:
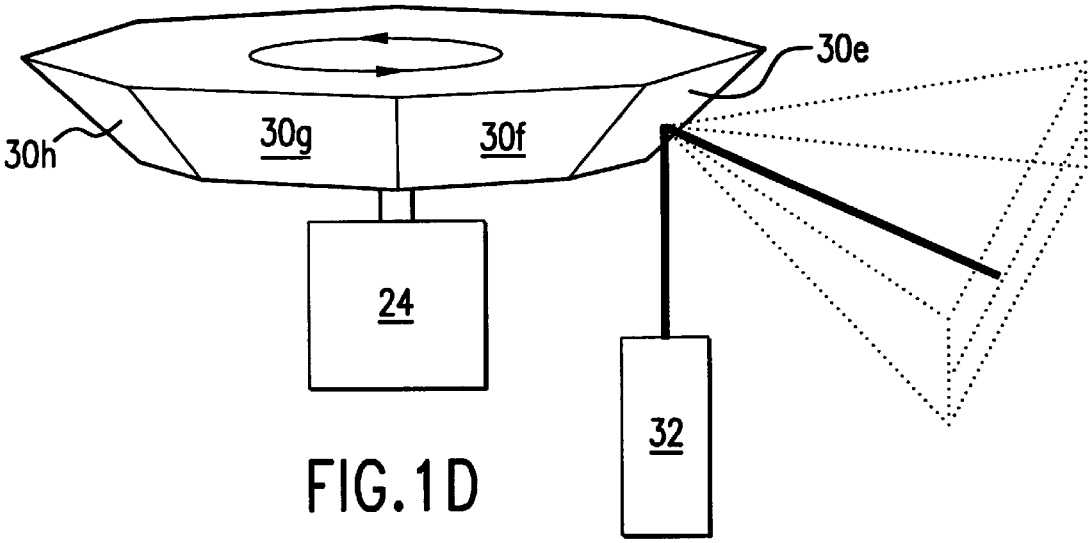
Figure 1E:
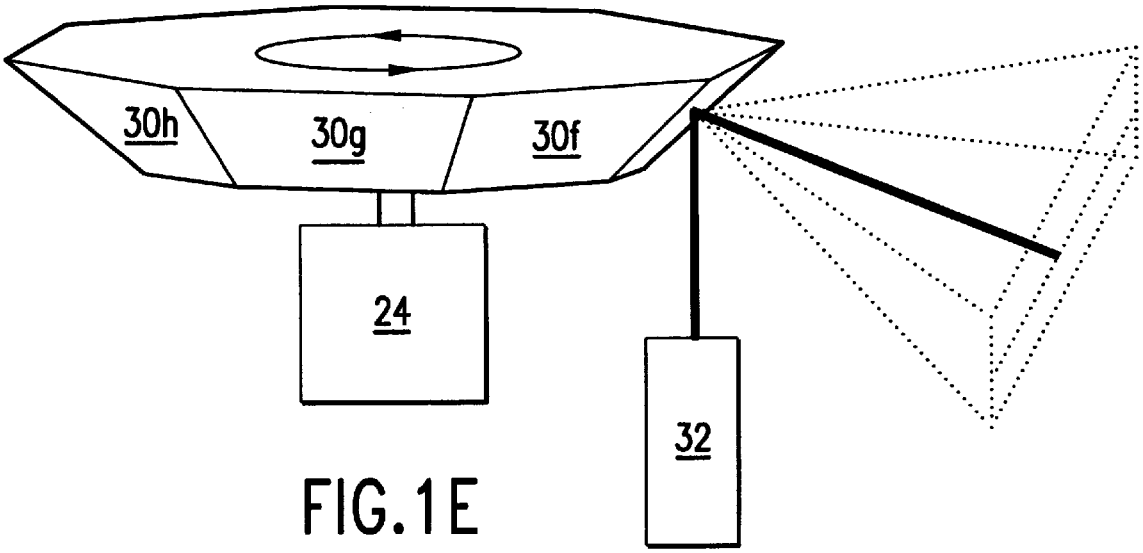
Figure 10:
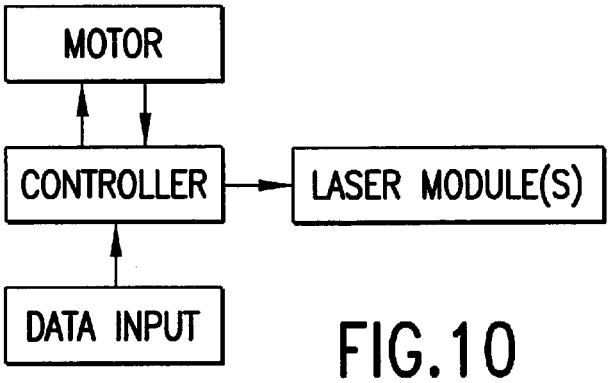
FIG. 10 is a simplified schematic diagram illustrating how a controller can be used to synchronize the rotation speed of a turntable with the on-off times of the laser modules for any of the embodiments of the present invention.

In all the embodiments of the present invention, the synchronization of the rate of rotation of the turntables with the on-off (i.e., switching) times of the laser modules is accomplished by providing a controller which is coupled to the motor and the laser modules (see FIG. 10). The controller may include a memory, such as a ROM, which contains pre-programmed instructions or software which synchronizes the rate of rotation of the turntables with the times at which the laser modules are turned on and turned off. Data input may be provided to the controller to change the times at which the laser beams are emitted, and the rotation rate of the turntables. The structures and operating principles for the controller and its software are well-known to those skilled in the art, and shall not be further elaborated on herein.

The laser systems 20*a*, 70, 70*a*, 90, 120 and 150 described above can be housed inside a housing. The housing can include an opening through which the reflected laser beams are emitted. In the embodiments where a projection lens is employed, the projection lens may be fitted at the opening in the housing. Such housings are well-known to those skilled in the art, and shall not be further elaborated on herein.

In addition, the rotation of the turntables in the laser systems 90, 120 and 150 can be either in a clockwise direction or in a counterclockwise direction. The turntables in the laser systems 20, 20*a*, 70 and 70*a* can also be rotated in either direction, except that the sequence of the mirrors has to be provided in the same rotational direction.

Thus, the dot matrix principle used by the laser systems 20, 20*a*, 70, 70*a*, 90, 120 and 150 of the present invention produces consistent and clear images. The laser systems 20*a*, 70, 70*a*, 90, 120 and 150 of the present invention are also simple in construction, since only one motor is required. This allows the laser systems 20*a*, 70, 70*a*, 90, 120 and 150 to be manufactured at lower cost to the consumers. In addition, the provision of a projection lens 80, 80*a*, 140, 170 allows for the size of the components of the laser systems to be decreased.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A system for producing an image, comprising:

a turntable having a circumference, and a plurality of adjacent mirrors arranged circumferentially about the turntable;

a motor rotatably coupled to the turntable;

a laser module adapted to emit a laser beam when it is turned on, the laser module oriented to direct the emitted laser beam at a first of the plurality of adjacent mirrors, the laser beam being reflected from the first mirror to a desired viewing space to form a portion of an image; and a controller operatively coupled to the laser module for turning on the laser module at selected times to form portions of the image, and also operatively coupled to the motor for synchronizing the rate of rotation of the turntable with the selected times at which the laser module is turned on.

2. The system of claim 1, wherein the plurality of adjacent mirrors is part of the turntable so that the plurality of adjacent mirrors rotate with the turntable, and wherein each of the plurality of adjacent mirrors is provided at a different angle with respect to a vertical axis.

3. The system of claim 2, wherein the turntable is rotated so that the laser module directs at least one laser beam at a second mirror that is adjacent the first mirror.

4. The system of claim 3, further including a projection lens oriented to receive the laser beams reflected from the first and second mirrors.

5. The system of claim 2, further including a plurality of laser modules, each simultaneously emitting a laser beam of a different color to the same location at the first mirror for reflection towards the desired viewing space.

6. The system of claim 3, further including a second laser module adapted to emit a second laser beam when it is turned on, the second laser module oriented to direct the emitted second laser beam at a second of the plurality of adjacent mirrors which is adjacent the first mirror, the second laser beam being reflected from the second mirror to the desired viewing space simultaneous with the reflection of the first laser beam from the first mirror.

7. The system of claim 2, wherein the turntable has an upper surface, and a lower surface which has a smaller profile than the upper surface.

8. The system of claim 1, wherein the plurality of adjacent mirrors is part of the turntable so that the plurality of adjacent mirrors rotate with the turntable, the system further including a first laser module and a second laser module, each laser module adapted to emit a laser beam when it is turned on, with the first and second laser modules oriented at different angles with respect to a vertical axis, so that the first laser module directs a laser beam at the plurality of adjacent mirrors at a location which is different from the location at which the second laser module directs its laser beam.

9. The system of claim 1, wherein the plurality of adjacent mirrors is part of the turntable so that the plurality of adjacent mirrors rotate with the turntable, the system further including a first laser module and a second laser module, each laser module adapted to emit a laser beam when it is turned on, with the first and second laser modules oriented at different vertical positions with respect to the turntable, so that the first laser module directs a laser beam at the plurality of adjacent mirrors at a location which is different from the location at which the second laser module directs its laser beam.

10. The system of claim 8, wherein the turntable is rotated so that the first and second laser modules direct laser beams at a second mirror that is adjacent the first mirror.

11. The system of claim 10, further including a projection lens oriented to receive the laser beams reflected from the first and second mirrors.

12. The system of claim 8, wherein the first laser module includes a first group of laser modules and the second laser module includes a second group of laser modules, each group of laser modules having first and second laser modules that emit laser beams of different colors to the same location at the first mirror for reflection towards the desired viewing space.

13. The system of claim 8, wherein the first laser module directs a first laser beam at a first mirror, the system further including a third laser module which is oriented to direct a third laser beam at a second of the plurality of adjacent mirrors which is adjacent a first mirror, the third laser beam being reflected from the second mirror to the desired viewing space simultaneous with the reflection of the first laser beam from the first mirror.

14. The system of claim 1, wherein each laser beam forms a dot, and the desired image comprises an arrangement of the dots.

15. A method of creating an image, comprising the steps of:

a. rotating a turntable having a circumference, and a plurality of adjacent mirrors arranged circumferentially about the turntable;

b. directing a laser beam at selected times at a first of the plurality of mirrors;

c. reflecting the laser beam from the first mirror to a desired viewing space to form portions of an image; and d. synchronizing the rate of rotation of the turntable with the selected times at which the laser beam is directed at the first mirror.

16. The method of claim 15, further including the steps of:

e. directing a laser beam at selected times at a second of the plurality of mirrors;

f. reflecting the laser beam from the second mirror to a desired viewing space to form portions of an image; and g. synchronizing the rate of rotation of the turntable with the selected times at which the laser beam is directed at the second mirror.

17. The method of claim 16, wherein step (c) includes the step of reflecting a laser beam from the first mirror at a first vertical level, and wherein step (f) includes the step of reflecting a laser beam from the second mirror at a second vertical level that is different from the first vertical level.

18. The method of claim 17, wherein step (a) includes the step of providing each of the plurality of adjacent mirrors at a different angle with respect to a vertical axis.

19. The method of claim 16, wherein step (b) includes the step of directing a laser beam at the first mirror at a first angle with respect to a vertical axis, and wherein step (e) includes the step of directing a laser beam at the second mirror at a second angle with respect to a vertical axis that is different from the first angle.

20. The method of claim 15, wherein the laser beam reflected from the first mirror produces a dot at the desired viewing space.

21. The method of claim 15, wherein step (c) further includes the step of directing the reflected the laser beam from the first mirror through a projection lens to a desired viewing space.

22. The method of claim 15, wherein step (b) further includes the step of directing first and second laser beams of different colors at the first mirror.

23. The method of claim 15, further including the steps of:

b1. directing a laser beam at a second of the plurality of mirrors adjacent the first mirror;

c1. reflecting the laser beam from the second mirror to a desired viewing space at the same time the laser beam from the first mirror is reflected to the desired viewing space; and d1. synchronizing the rate of rotation of the turntable with the time at which the laser beam is directed at the second mirror.

* * * * *